US007563116B2

(12) United States Patent
Wang

(10) Patent No.: US 7,563,116 B2
(45) Date of Patent: Jul. 21, 2009

(54) ELECTRICAL CONNECTOR WITH SWITCHING TERMINALS

(75) Inventor: Ji-Cheng Wang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/284,364

(22) Filed: Sep. 22, 2008

(65) Prior Publication Data

US 2009/0081904 A1 Mar. 26, 2009

(30) Foreign Application Priority Data

Sep. 22, 2007 (CN) ..... 2007 2 0044133 U

(51) Int. Cl.
*H01R 29/00* (2006.01)

(52) U.S. Cl. ..... 439/188

(58) Field of Classification Search ..... 439/181, 439/638, 188, 676, 108, 941
See application file for complete search history.

(56) References Cited

U.S. PATENT DOCUMENTS

| | | | | |
|---|---|---|---|---|
| 6,231,362 | B1 * | 5/2001 | Wu | 439/188 |
| 7,241,157 | B2 * | 7/2007 | Zhuang et al. | 439/188 |
| 2005/0227524 | A1 * | 10/2005 | Zhuang et al. | 439/188 |
| 2005/0282442 | A1 * | 12/2005 | Hyland et al. | 439/676 |
| 2008/0032562 | A1 * | 2/2008 | McHugh et al. | 439/668 |

* cited by examiner

*Primary Examiner*—Neil Abrams
*Assistant Examiner*—Phuong Nguyen
(74) *Attorney, Agent, or Firm*—Wei Te Chung

(57) ABSTRACT

An electrical connector includes an insulating housing defining a receiving cavity surrounded by opposite sidewalls and a top and bottom wall connecting with the sidewalls, a plurality of contacts retained on the housing, a couple of switching terminals including a first terminal and a second terminal, and a shell surrounding the insulating housing. One of said side wall defines two slots. The two terminals are received and retained in said two slots and mates with each others when a complementary connector is inserted into the receiving cavity. The first terminal defines a touching tab contacting with the shell.

19 Claims, 6 Drawing Sheets

ELECTRICAL CONNECTOR WITH SWITCHING TERMINALS

BACKGROUND OF THE INVENTION

1. Field of the Invention

The present invention relates to an electrical connector with a coupe of switching terminals thereof.

2. Description of Related Art

TW Patent Issue No. M298264 discloses a conventional modular jack, which has a couple of switching terminals for detection. A moveable terminal of the couple of the switching terminals is retained in an inner side of one sidewall of an insulating housing of the jack. A corresponding immoveable terminal is retained in a projection at an outer side of the sidewall, which has a vertical portion abutting against a shell covered on the hosing and a horizontal portion going across the projection to correspond to the moveable terminal. The moveable terminal is pressed outwards to engage with the horizontal portion of the immoveable terminal when a complementary connector is inserted into the jack. The transverse length is larger because of transversely positioning of the immoveable terminal and the projection.

Therefore, an improved electrical connector is desired to overcome the disadvantages of the prior arts.

SUMMARY OF THE INVENTION

An object of the present invention is to provide an electrical connector with a couple of switching terminals and having a smaller size.

In order to achieve above-mentioned object, an electrical connector comprises an insulating housing defining a receiving cavity surrounded by opposite sidewalls and a top and bottom wall connecting with the sidewalls, a plurality of contacts defining contacting portions extending into the receiving cavity, a couple of switching terminals including a first terminal and a second terminal, and a shell surrounding the insulating housing. One of said side wall defines two slots in a mating direction. The two terminals are received and retained in said two slots and mates with each others when a complementary connector is inserted into the receiving cavity. The first terminal defines a touching tab mechanically contacting with the shell.

Other objects, advantages and novel features of the present invention will become more apparent from the following detailed description of the present embodiment when taken in conjunction with the accompanying drawings.

DETAILED DESCRIPTION OF THE INVENTION

Figure 1:
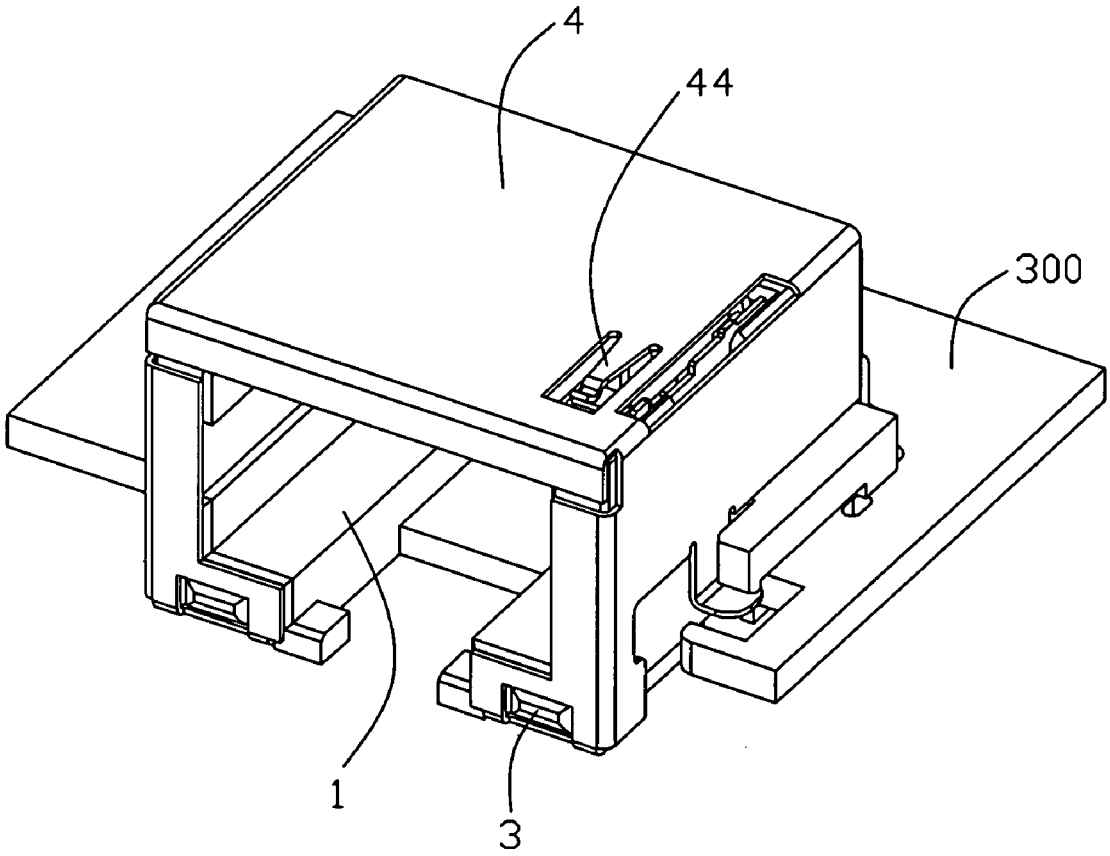
FIG. 1 is a perspective view of an electrical connector accordance with the present invention, which is assembled on a PCB.

Reference will now be made to the drawing figures to describe the preferred embodiment of the present invention in detail.

Referring to FIG. 1, an electrical connector 100 in accordance with a preferred embodiment of the present invention is a sunken one assembled in a notch of a PCB 300, which is adapted for transmitting network communication signal. The connector 100 comprises an insulating housing 1, a plurality of conductive contacts in the housing, a LED device 3 and a shell 4 surrounding the housing.

Figure 2:
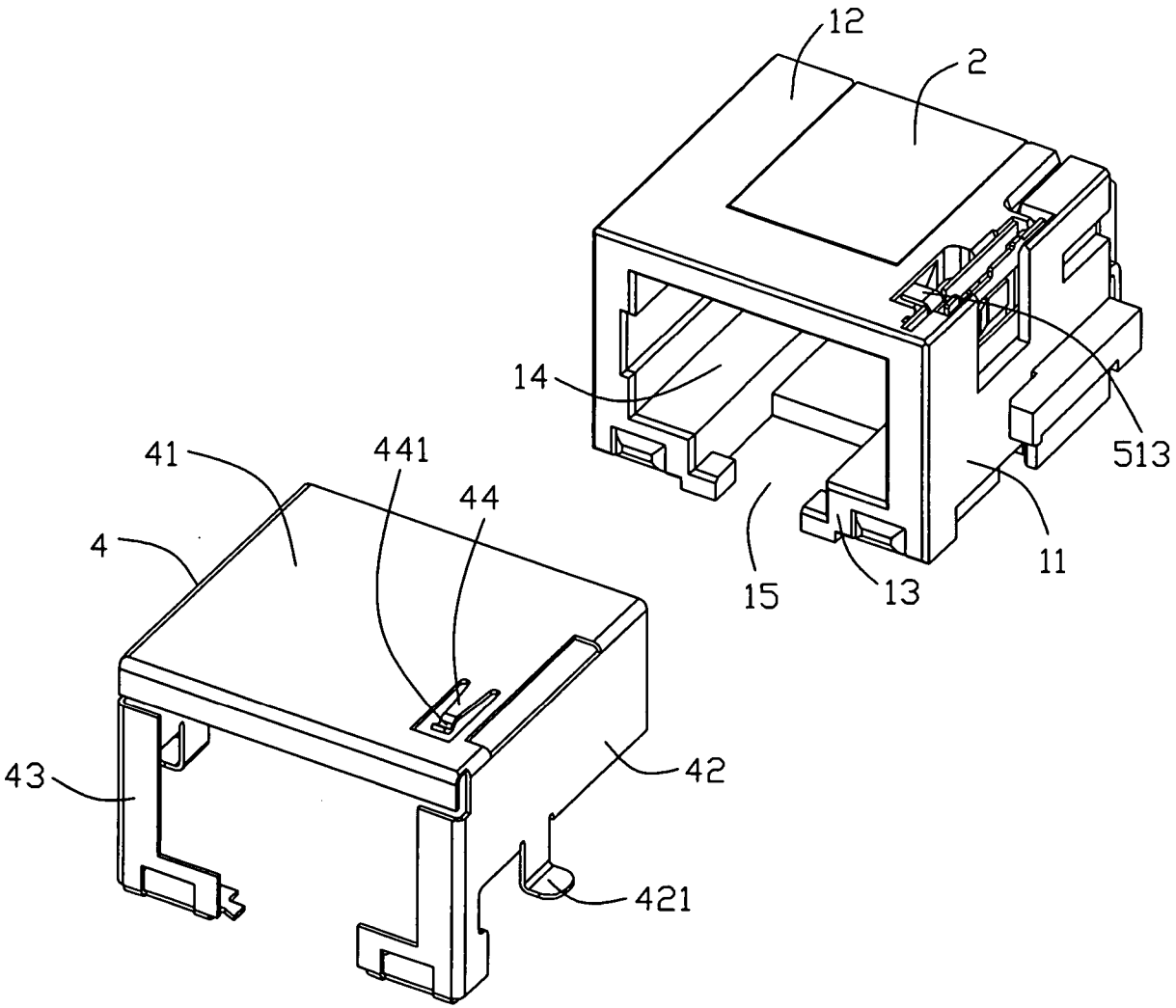
FIG. 2 is an exploded perspective view of connector shown in FIG. 1.
Figure 3:
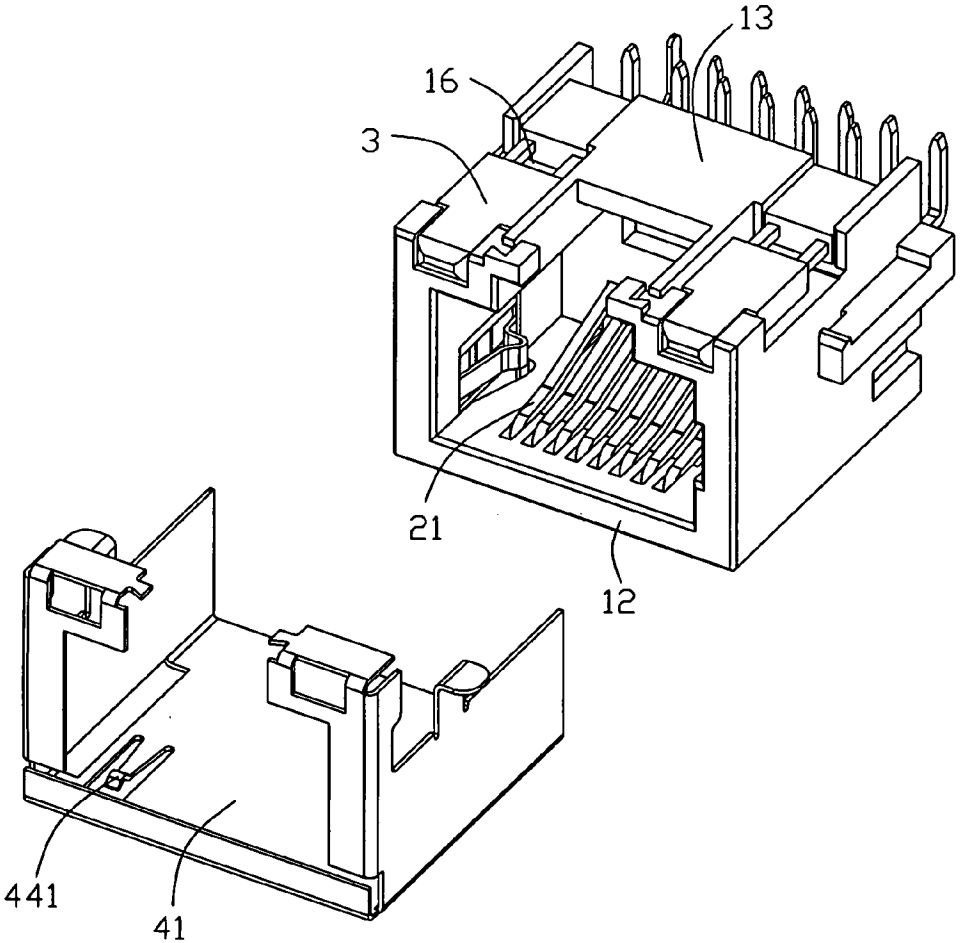
FIG. 3 is an exploded perspective view of connector from the bottom view.

Referring to FIGS. 2 and 3, the insulating housing 1 are formed by a pair of opposite sidewalls 11, a top wall 12 and a bottom wall 13, which commonly form a receiving cavity 14. A contact module 2 is substantially L-shaped and provided with the plurality of the contact 21 integrally therein. The contact module 2 is fitly located in an opening defined in the top wall 12 of the housing and partly functions as a rear wall of the housing. The receiving cavity 14 opens forwards for being inserted by a complementary connector. The bottom wall 13 defines a latching notch 15 opening forwards for latching a locking potion of the complementary connector. The bottom wall further is provide with a pair of grooves 16 at two sides thereof to receive the LED device 3. The legs of the LED device extend out of the rear wall of the housing 1. The shell 4 includes a top wall 41 covering corresponding top wall 12 of the housing and a pair of sidewalls 42 perpendicularly extending from the top wall thereof. A front wall 43 defines openings (not labeled) corresponding to the receiving cavity 14, the LED device and the latching notch 15. The bottom wall 13, i.e. a mounting face of the connector abuts against the PCB 300 and a pair of legs 421 of the shell extends downwards to be soldered on the PCB. The top wall 41 of the shell 4 has a spring tab 44 punched adjacent to one sidewall of the shell and the spring tab 44 extends forwards with an arc contacting portion 441 projecting inward at a free end thereof.

Figure 4:
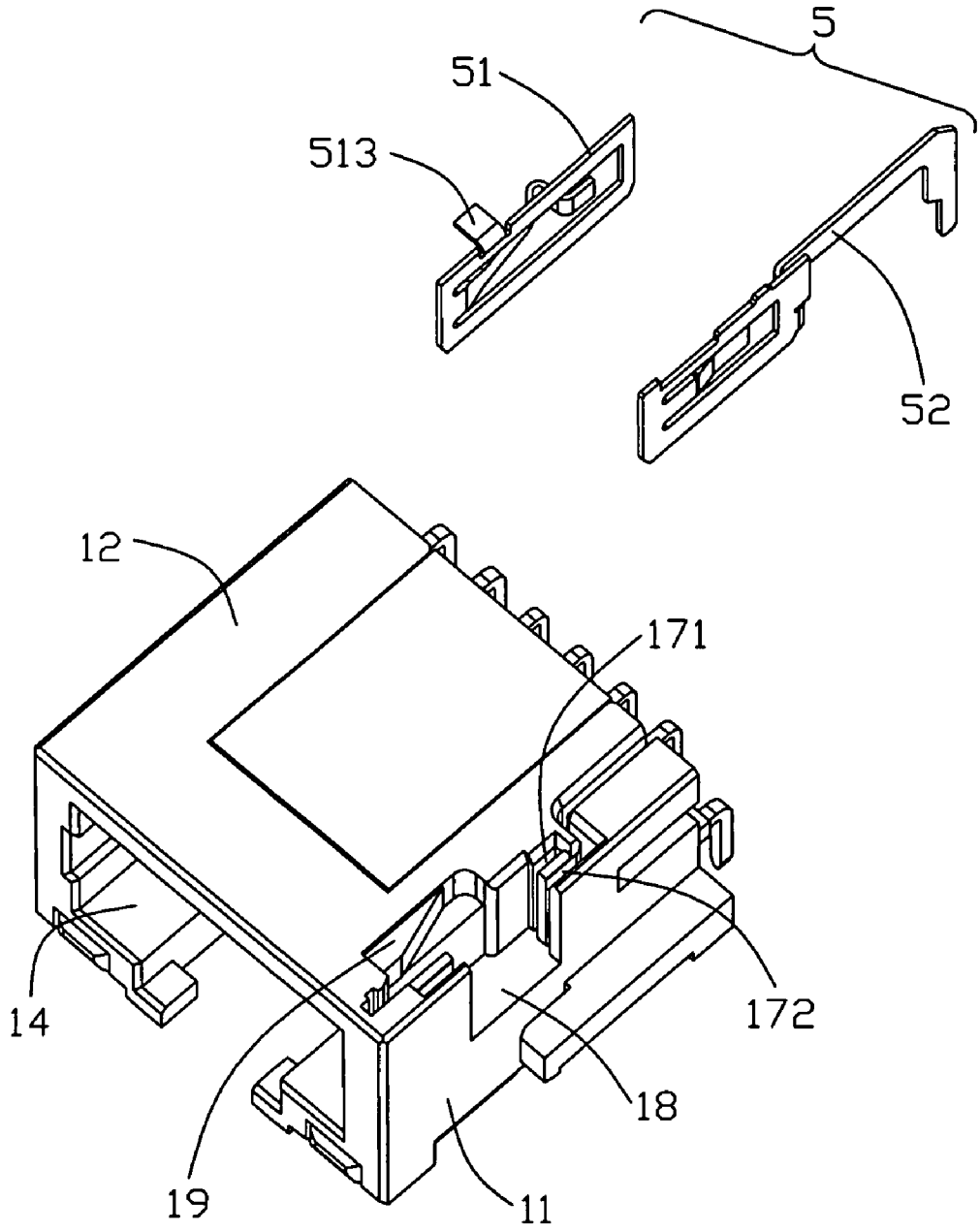
FIG. 4 is a perspective view of an insulating housing and a couple of switching terminals of the connector.

Referring to FIG. 4, one side wall 11 of the housing defines two slots 171,172 along a front-to-rear direction, i.e. a mating direction of the complementary connector. The two slots open upwards and through the top wall 12, and the first slot 171 is located inside of the second slot 172. The middle portions of the two slots run through the inner and outer faces of the side wall of the housing to communicate with the cavity 14 and an exterior of the housing 1, thereby an opening 18 is formed. The top wall 12 of the housing is recessed downward to form a supporting portion 19 lower than the top wall 12.

Figure 5:
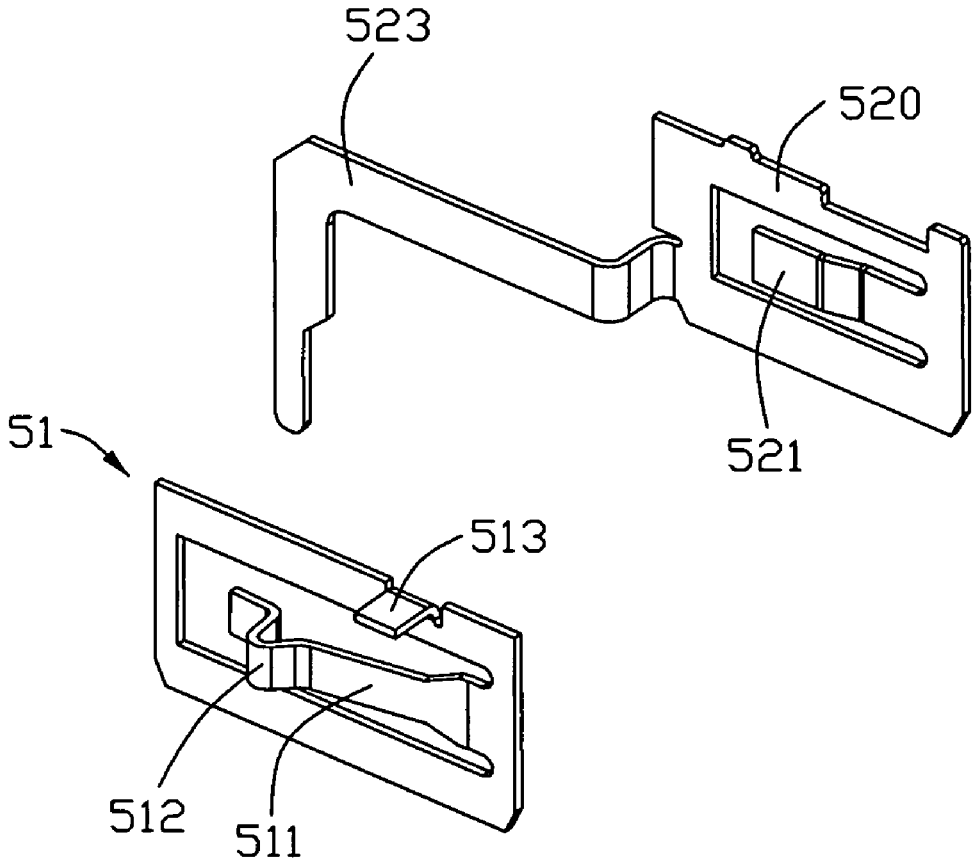
FIG. 5 is a perspective view of the couple of the switching terminals.

Referring to FIGS. 4 and 5, the couple of the switching terminals 5, a first terminal 51 and a second terminal 52 mating with each other, is received in the two slot 171,172, respectively. The first terminal 51 of window shape includes a spring arm portion 511 extending from an inner edge of the window portion with an inward arc contacting portion 512 adjacent to a free end thereof. A touching tab 513 perpendicularly extends inwards from a top edge of the window portion while the first terminal has no leg adapted for mechanically and electrical connection to the PCB 300. The second terminal 52 includes a window portion 520 and a leg 523 bending and extending rearward from the rear edge of the frame 520. A spring arm portion 521 extends from a front inner edge of the window portion and slightly slant inwards.

The first terminal 51 and second terminal 52 are inserted into the first and the second slot 171, 172, respectively, from the top wall 12 and retained in the slots by the window portions thereof mainly, i.e., the window portions function as retaining portions. As shown in FIG. 2, the touching tab 513 is just located on the supporting portion 19 and the contacting portion 441 of the spring tab just presses against the touching tab 513 to service as a grounding path. Alternatively, the touching tab 513 may be provide on the second terminal 52 upward bending or downward bending to contacting with the top wall of the shell or the sidewall of the shell.

Figure 6:
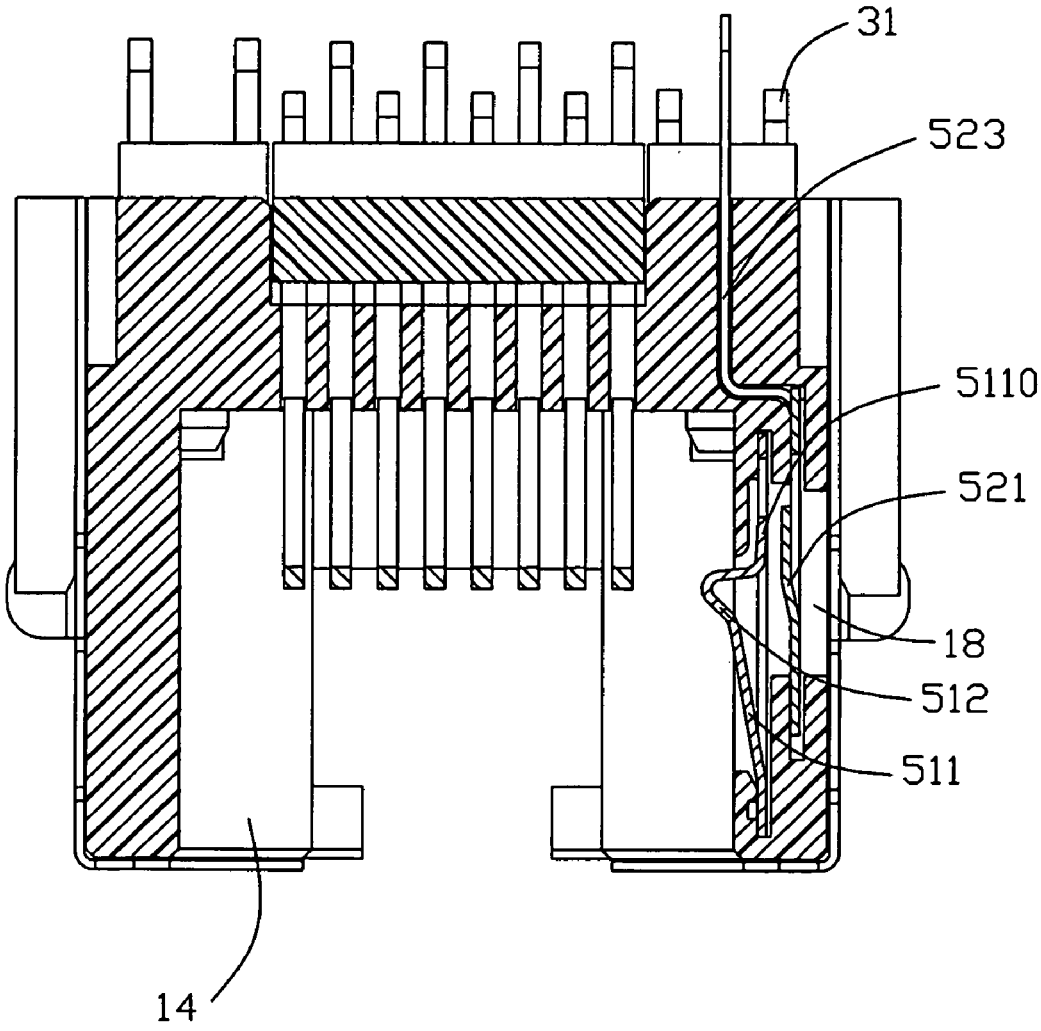
FIG. 6 is a schematic view of the connector to show the couple of the switching terminals.

As shown in FIG. 6, the contacting portion 512 projects into the receiving cavity 14 through the opening 18, and the leg 523 and corresponding slot bent inwards to meet arrangement of the leg of the LED device. The contacting portion 512 will horizontally move outwards along the opening 18, which is urged by the sidewalls of the complementary connector inserted in the receiving cavity 14, wherein the front end 5110 of the arm portion 511 of the first terminal touches with the arm portion 521 of the second terminal 52 to complete detecting function.

However, the disclosure is illustrative only, changes may be made in detail, especially in matter of shape, size, and arrangement of parts within the principles of the invention.

What is claimed is:

1. An RJ jack connector comprising:

an insulating housing defining a receiving cavity surrounded by opposite sidewalls and a top and bottom wall connecting with the sidewalls, one of said side wall defining two slots along a mating direction of a complementary connector;

a plurality of conductive contacts defining contacting portions extending into the receiving cavity;

a couple of switching terminals including a first terminal and a second terminal received and retained in said two slots respectively, and the two terminals being mating with each others when the complementary connector is inserted into the receiving cavity; and a shell surrounding the insulating housing, the shell comprising a spring tab;

wherein the first terminal defines a touching tab mechanically contacting with the shell;

the touching tab of the first terminal perpendicularly extends inwards from a top edge of the receiving cavity while the first terminal has no leg adapted for mechanically and electrical connection to a printed circuit broad (PCB);

the first terminal is located adjacent to the receiving cavity, and comprises a spring arm portion extending from an inner edge of the receiving cavity with an inward arc contacting portion adjacent to a free end thereof and projecting into the receiving cavity from;

wherein the second terminal defines an arm portion extending along a same direction with the spring arm portion of the first terminal, the arm portion of the second terminal is moveably engaged by a free end of the first terminal;

the touching tab is just located on a supporting portion of the housing and the contacting portion of the spring tab just presses against the touching tab to service as a grounding path.

2. The connector as described in claim 1, wherein the first and second terminal each defines a contacting portion to mating with each other, the second terminal defines a leg for mechanically and electrically connecting with a PCB where the electrical connector mounted while the second terminal defines a touching tab thereon without a leg mechanically connecting with the PCB.

3. The connector as described in claim 2, wherein the two slots run through the top wall of the housing and one slot runs through a rear wall of the housing to receiving the leg of the second terminal.

4. The connector as described in claim 1, wherein; a top wall of the shell covering the top wall of the housing.

5. The connector as described in claim 4, wherein; the bottom wall defines a latching notch.

6. The connector as described in claim 5, wherein said two slots defines an opening communicating with the receiving cavity and an exterior.

7. The connector as described in claim 1, wherein; a front wall of the housing defines openings for receiving LED devices.

8. The connector as described in claim 7, wherein the first terminal defines a retaining portion of the receiving cavity, and said touching tab bends and extends from the retaining portion.

9. The connector as described in claim 8, wherein the top wall of the housing defines a supporting portion recessed therein, the touching tab extends from a top edge of the retaining portion and locates on the supporting portion.

10. An RJ Jack connector comprising:

an insulating housing defining a receiving cavity for receiving a complementary connector, a mating direction of the complementary connector and a mounting face for a PCB where the electrical connector is mounted, two slots being provided on a sidewall of the housing and running through a second face opposite to the mounting face of the housing;

a plurality of conductive contacts receiving in the housing;

a couple of switching terminals inserted into said two slots from said second face, having a moveable terminal and an immoveable terminal; and a shell surrounding the insulating housing;

wherein one of said couple of the switch terminals defines a touching tab mechanically contacting with the shell;

the touching tab of one of the switch terminals perpendicularly extends inwards from a top edge of the receiving cavity while the one of the switch terminals has no leg adapted for mechanically and electrical connection to a printed circuit broad (PCB);

the one of the switch terminals is located adjacent to the receiving cavity, and comprises a spring arm portion extending from an inner edge of the receiving cavity with an inward arc contacting portion adjacent to a free end thereof and projecting into the receiving cavity from;

wherein an other terminal of the switch terminals defines an arm portion extending along a same direction with the spring arm portion of the one of the switch terminals, the arm portion of the other terminal is moveably engaged by a free end of the one of the switch terminals;

the touching tab is just located on a supporting portion of the housing and the contacting portion of the spring tab just presses against the touching tab to service as a grounding path.

11. The connector as described in claim 10, wherein the bottom wall defines a latching notch.

12. The connector as described in claim 10, wherein; a front wall of the housing defines openings for receiving LED devices.

13. The connector as described in claim 12, wherein; a top wall of the shell covering the top wall of the housing.

14. An RJ Jack connector for mounting to a printed circuit board, comprising:

an insulative housing defining a plug receiving cavity;

a plurality of contacts disposed in the housing with contacting sections extending into the plug receiving cavity;

a metallic shell enclosing said housing;

first and second switch terminals disposed on a side of said receiving cavity; and said first and second switch terminals has a first portion constantly engaged with the shell, a second portion moveably extending into the plug receiving cavity, and a third portion moveably on and off engaged with the second switch terminal; wherein the first portion of the first terminal perpendicularly extends inwards from a top edge of the receiving cavity while the first switch terminal has no tail connected to the printed circuit board while said second switch terminal has;

the first terminal is located adjacent to the receiving cavity, and comprises the second portion extending from an inner edge of the receiving cavity with the third portion adjacent to a free end thereof and projecting into the receiving cavity from;

wherein the second terminal defines the second extending along a same direction with the second portion of the first terminal, the third portion of the second terminal is moveably engaged by a third portion of the first terminal;

the first portion is just located on a supporting portion of the housing and a contacting portion of a spring tab of the shell just presses against the first portion of the first terminal to service as a grounding path.

15. The connector as described in claim 14, wherein said first portion of the second switch terminal and the second portion of the first switch terminal are generally aligned with each other in a front-to-back direction of said receiving cavity.

16. The connector as described in claim 14, wherein said second portion and said third portion of the first switch terminal are moveable in a lateral direction perpendicular to a front-to-back direction of the receiving cavity.

17. The connector as described in claim 14, wherein said housing defines a slot extending from a top face thereof for top loading the first switch terminal into the housing.

18. The connector as described in claim 17, wherein said first portion is intimately located right below a top wall of the shell.

19. The connector as described in claim 18, wherein the spring arm is defined in said top wall of the shell to engage said first portion.

* * * * *